US010013010B1

(12) United States Patent
Ock et al.

(10) Patent No.: US 10,013,010 B1
(45) Date of Patent: Jul. 3, 2018

(54) VOLTAGE DROOP MITIGATION CIRCUIT FOR POWER SUPPLY NETWORK

(71) Applicant: QUALCOMM Incorporated, San Diego, CA (US)

(72) Inventors: Sungmin Ock, San Diego, CA (US); Xuhao Huang, San Diego, CA (US)

(73) Assignee: QUALCOMM Incorporated, San Diego, CA (US)

( * ) Notice: Subject to any disclaimer, the term of this patent is extended or adjusted under 35 U.S.C. 154(b) by 0 days.

(21) Appl. No.: 15/398,825

(22) Filed: Jan. 5, 2017

(51) Int. Cl.
*G05F 1/575* (2006.01)

(52) U.S. Cl.
CPC ..... *G05F 1/575* (2013.01)

(58) Field of Classification Search
CPC ..... G05F 1/575; G05F 1/563
See application file for complete search history.

(56) References Cited

U.S. PATENT DOCUMENTS

| | | | | |
|---|---|---|---|---|
| 6,977,490 | B1 * | 12/2005 | Zhang | G05F 1/575 323/280 |
| 7,126,798 | B2 | 10/2006 | Piorun et al. | |
| 7,521,909 | B2 * | 4/2009 | Dow | G05F 1/575 323/274 |
| 9,122,292 | B2 | 9/2015 | Pan et al. | |
| 9,285,814 | B1 * | 3/2016 | Agarwal | G05F 1/575 |
| 9,753,473 | B2 * | 9/2017 | Tan | G05F 1/575 |
| 2009/0224737 | A1 * | 9/2009 | Lou | G05F 1/563 323/280 |
| 2014/0266103 | A1 | 9/2014 | Wang et al. | |
| 2015/0220094 | A1 * | 8/2015 | Ho | G05F 1/575 323/280 |
| 2016/0179163 | A1 | 6/2016 | Haider et al. | |
| 2016/0179181 | A1 | 6/2016 | Doyle et al. | |
| 2016/0266591 | A1 * | 9/2016 | Hua | G05F 1/575 |
| 2016/0349776 | A1 * | 12/2016 | Conte | G05F 1/575 |

* cited by examiner

*Primary Examiner* — Kyle J Moody
(74) *Attorney, Agent, or Firm* — Patterson & Sheridan, L.L.P.

(57) ABSTRACT

A voltage droop reduction circuit generally including a loop coupled to an output of a voltage regulator is provided. The loop includes a first current amplifier. The voltage droop reduction circuit may also include a first capacitor coupled between the output of the voltage regulator and an input of the first current amplifier.

25 Claims, 6 Drawing Sheets

VOLTAGE DROOP MITIGATION CIRCUIT FOR POWER SUPPLY NETWORK

TECHNICAL FIELD

Certain aspects of the present disclosure generally relate to electronic circuits and, more particularly, to a circuit for a power supply.

BACKGROUND

Power management integrated circuits (power management ICs or PMICs) are used for managing the power requirement of a host system. A PMIC may be used in battery-operated devices, such as mobile phones, tablets, laptops, wearables, etc., to control the flow and direction of electrical power in the devices. The PMIC may perform a variety of functions for the device such as DC-to-DC conversion, battery charging, power-source selection, voltage scaling, power sequencing, etc. In some cases, a low-dropout (LDO) regulator and/or a block head switch (BHS) may be coupled to the PMIC for providing a supply voltage to one or more loads.

An LDO regulator is a voltage regulator that can regulate its output voltage even when the supply voltage of the LDO regulator is close to the output voltage. A block head switch (BHS) generally refers to a switch for coupling a voltage supply to a load. A BHS may have low resistance, thereby resulting in a low voltage drop across the BHS. BHSs may be used to couple a supply voltage provided by the PMIC to one or more loads. However, as a BHS is unable to regulate the supply voltage provided by the PMIC, the supply voltage applied to each load may be above the desired voltage of the load, reducing efficiency. On the other hand, LDO regulators can regulate a supply voltage, and thus, can be used to provide different supply voltages to each load, even from a single supply voltage provided by the PMIC. Therefore, when a single supply voltage is provided by the PMIC for different loads, an LDO and a BHS could be employed in parallel. If a first load is to be provided a supply voltage that is close to the supply voltage provided by the PMIC, then the BHS may be turned on and the LDO regulator may be turned off. However, if a second load is to be supplied a lower supply voltage than the supply voltage supplied by the PMIC, then the LDO regulator may be turned on and the BHS may be turned off, such that the LDO regulator can provide a regulated voltage supply to the second load.

SUMMARY

Certain aspects of the present disclosure generally relate to techniques and apparatus for reducing voltage droop of a power supply circuit.

Certain aspects of the present disclosure provide a voltage droop reduction circuit. The voltage droop reduction circuit may include a loop coupled to an output of a voltage regulator, the loop comprising a first current amplifier; and a first capacitor coupled between the output of the voltage regulator and an input of the first current amplifier.

Certain aspects of the present disclosure provide a method for reducing voltage droop. The method generally includes detecting a change in voltage at an output of a voltage regulator using at least a portion of a loop comprising a capacitor coupled to an input of a first current amplifier, and supplying a first current to the output of the voltage regulator, via the loop, based at least in part on the detected change in voltage.

Certain aspects of the present disclosure provide an apparatus for reducing voltage droop. The apparatus generally includes means for generating a first current based on detection of a change in voltage at a node, means for amplifying the generated first current, and means for adjusting a gate-to-source voltage (Vgs) of a first transistor based on the amplified current, a drain of the first transistor being coupled to the node.

BRIEF DESCRIPTION OF THE DRAWINGS

So that the manner in which the above-recited features of the present disclosure can be understood in detail, a more particular description, briefly summarized above, may be had by reference to aspects, some of which are illustrated in the appended drawings. It is to be noted, however, that the appended drawings illustrate only certain typical aspects of this disclosure and are therefore not to be considered limiting of its scope, for the description may admit to other equally effective aspects.

DETAILED DESCRIPTION

Various aspects of the disclosure are described more fully hereinafter with reference to the accompanying drawings. This disclosure may, however, be embodied in many different forms and should not be construed as limited to any specific structure or function presented throughout this disclosure. Rather, these aspects are provided so that this disclosure will be thorough and complete, and will fully convey the scope of the disclosure to those skilled in the art. Based on the teachings herein one skilled in the art should appreciate that the scope of the disclosure is intended to cover any aspect of the disclosure disclosed herein, whether implemented independently of or combined with any other aspect of the disclosure. For example, an apparatus may be implemented or a method may be practiced using any number of the aspects set forth herein. In addition, the scope of the disclosure is intended to cover such an apparatus or method which is practiced using other structure, functionality, or structure and functionality in addition to or other than the various aspects of the disclosure set forth herein. It should be understood that any aspect of the disclosure disclosed herein may be embodied by one or more elements of a claim.

The word "exemplary" is used herein to mean "serving as an example, instance, or illustration." Any aspect described herein as "exemplary" is not necessarily to be construed as preferred or advantageous over other aspects.

An Example Device

Figure 1:
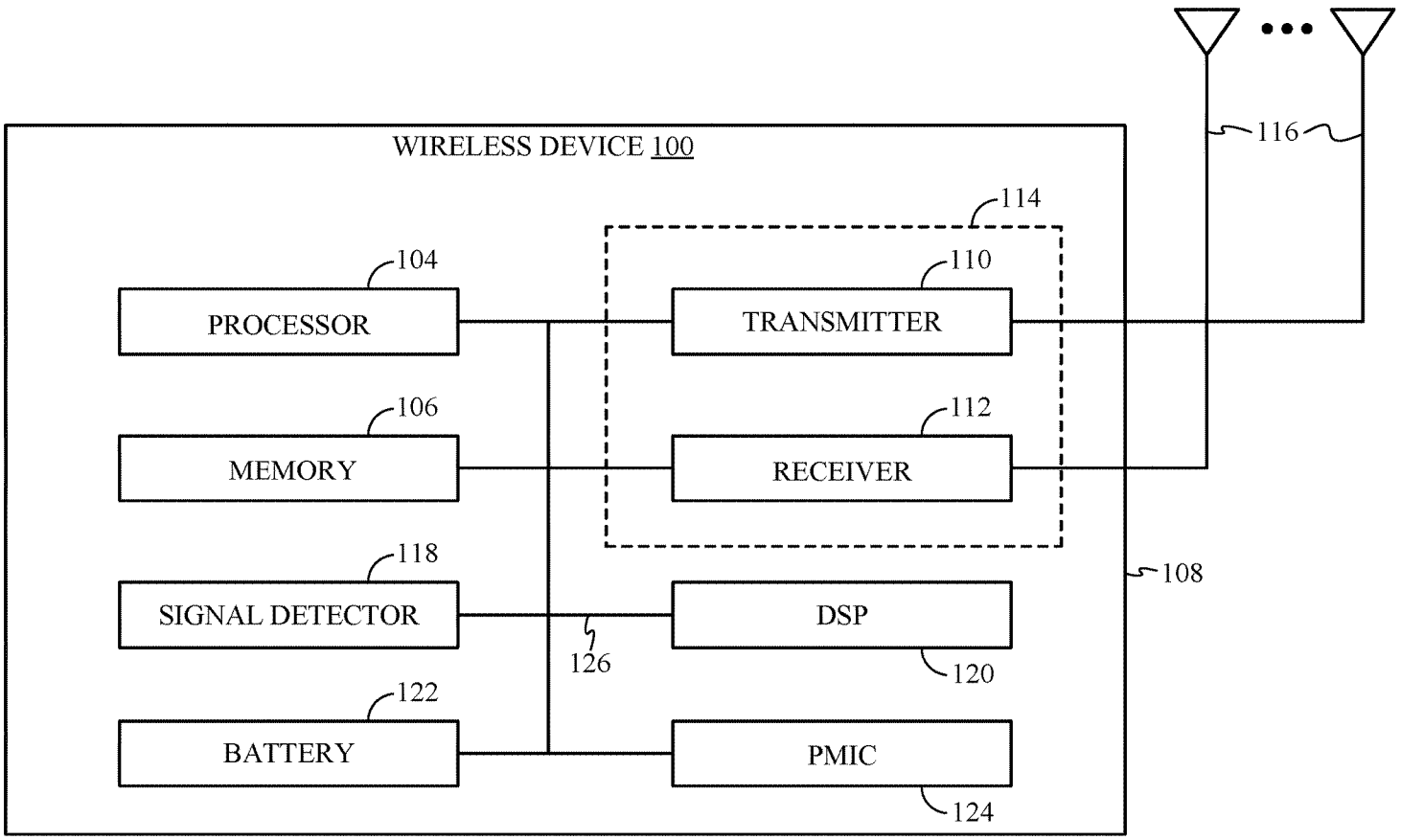
FIG. 1 illustrates a block diagram of an example device including a voltage regulator, according to certain aspects of the present disclosure.

FIG. 1 illustrates an example device 100 in which aspects of the present disclosure may be implemented. The device 100 may be a battery-operated device such as a cellular phone, a personal digital assistant (PDA), a handheld device, a wireless modem, a laptop computer, a tablet, a personal computer, etc.

The device 100 may include a processor 104 that controls operation of the device 100. The processor 104 may also be referred to as a central processing unit (CPU). Memory 106, which may include both read-only memory (ROM) and random access memory (RAM), provides instructions and data to the processor 104. A portion of the memory 106 may also include non-volatile random access memory (NVRAM). The processor 104 typically performs logical and arithmetic operations based on program instructions stored within the memory 106.

In certain aspects, the device 100 may also include a housing 108 that may include a transmitter 110 and a receiver 112 to allow transmission and reception of data between the device 100 and a remote location. The transmitter 110 and receiver 112 may be combined into a transceiver 114. A plurality of transmit antennas 116 may be attached to the housing 108 and electrically coupled to the transceiver 114. The device 100 may also include (not shown) multiple transmitters, multiple receivers, and multiple transceivers.

The device 100 may also include a signal detector 118 that may be used in an effort to detect and quantify the level of signals received by the transceiver 114. The signal detector 118 may detect such signal parameters as total energy, energy per subcarrier per symbol, and power spectral density, among others. The device 100 may also include a digital signal processor (DSP) 120 for use in processing signals.

The device 100 may further include a battery 122 used to power the various components of the device 100. The device 100 may also include a power management integrated circuit (power management IC or PMIC) 124 for managing the power from the battery to the various components of the device 100. The PMIC 124 may perform a variety of functions for the device such as DC-to-DC conversion, battery charging, power-source selection, voltage scaling, power sequencing, etc. In certain aspects, the PMIC 124 may include a power supply circuit. In certain aspects, the power supply circuit may include a voltage regulator (e.g., low-dropout regulator (LDO)) to generate a regulated voltage to be applied to one or more loads. In some cases, the PMIC 124 may generate the regulated voltage via a block head switch (BHS) circuit. The various components of the device 100 may be coupled together by a bus system 126, which may include a power bus, a control signal bus, and/or a status signal bus in addition to a data bus.

Example Voltage Droop Reduction Circuit for Power Supply Network

Certain aspects of this present disclosure generally relate to a voltage droop reduction circuit that may be used to sense and mitigate any voltage droops of a voltage generated by a power supply circuit. For example, a regulator, which may be implemented by a LDO regulator and/or a BHS switch, may be used to couple a supply voltage provided by the PMIC to a load. The regulator may be used to generate a regulated voltage at an output node of the power supply circuit that may be coupled to a load. In some cases, the regulator may be coupled to a voltage rail through a power distribution network (PDN). The PDN may be used for distribution of power to one or more components or circuits. For example, the bus 126 may include power lines for providing power to the components of the device 100. The PDN may be coupled to the power lines of the bus 126 and be used to distribute the power to the components of the device 100.

In some cases, the regulator may experience an increased current draw from the load, referred to herein as a load attack. Due to the load attack and the PDN, the voltage at the output node may experience a voltage droop (e.g., a reduction in the voltage at the output node). As one solution to the problem of voltage droop, the regulator may be designed to increase the voltage margin at the output node. For example, the regulator may be designed to provide a higher nominal output voltage such that at least a desired voltage level is maintained, even when a voltage droop is experienced at the output node due to a load attack. However, designing the regulator to provide a higher nominal voltage may have a negative impact on the power efficiency of the regulator.

Certain aspects of the present disclosure provide a circuit for reducing the voltage droops at the output of the regulator. By reducing the voltage droop at the output of the regulator, the power efficiency of the device 100 may be increased.

Figure 2:
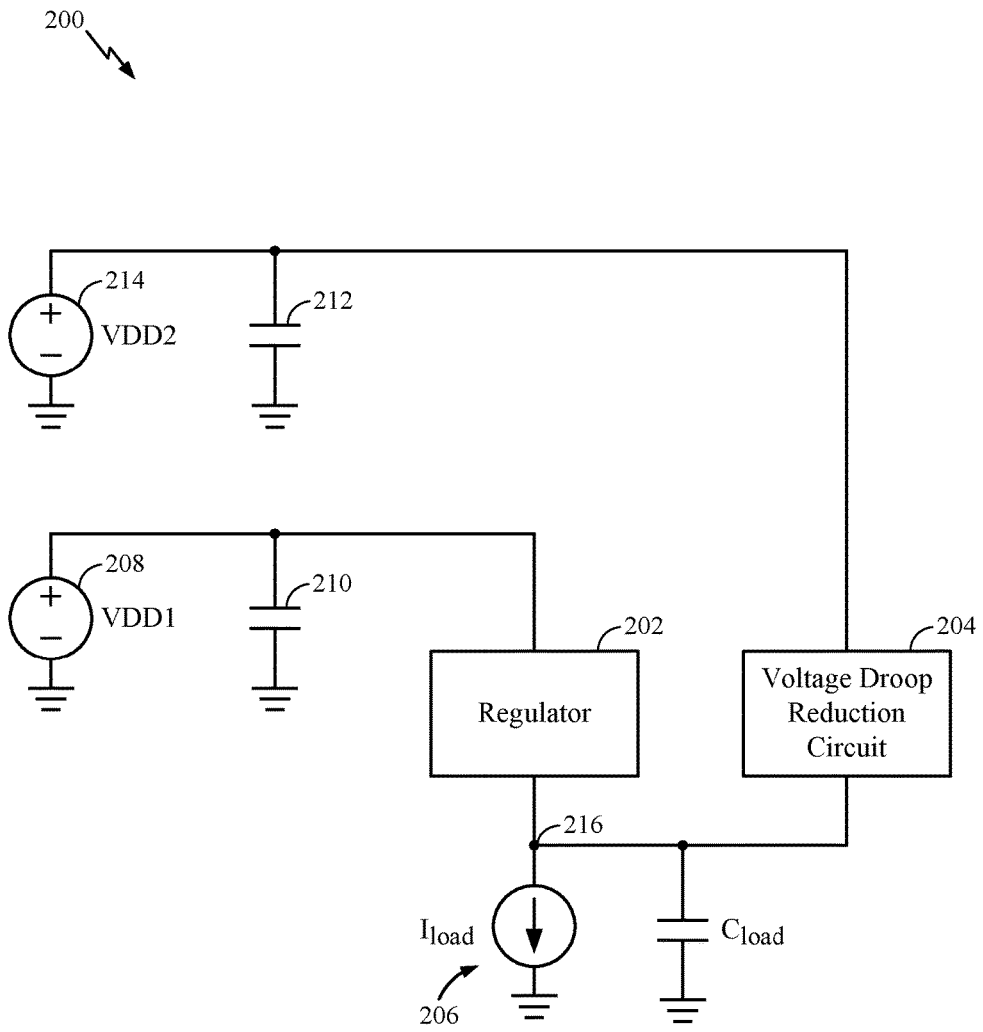
FIG. 2 illustrates an example power supply circuit, in accordance with certain aspects of the present disclosure.

FIG. 2 illustrates an example power supply circuit 200, in accordance with certain aspects of the present disclosure. The power supply circuit 200 includes a regulator 202 that may be coupled to a load 206. In certain aspects, the regulator 202 may be implemented using a LDO regulator or BHS circuit. In FIG. 2, the load 206 is represented by a current source $I_{load}$ coupled to node 216. In some cases, the load 206 may also include a lumped capacitor $C_{load}$ representing one or more capacitors for energy storage. For example, the current source $I_{load}$ may be connected in parallel with the capacitor $C_{load}$.

The regulator 202 may regulate the voltage VDD1 generated by the voltage supply 208. In some cases, the voltage supply 208 may be coupled to a capacitor 210. The capacitor 210 may store and provide power to the regulator 202 during moments of peak power draw by the regulator 202. In some cases, the size of the capacitor 210 and the capacitor $C_{load}$ may be increased, increasing the total energy storage capability of the capacitor 210 and capacitor $C_{load}$, in order to reduce the voltage droop at the output node.

In certain aspects, a voltage droop reduction circuit 204 may be coupled to the load 206. The voltage droop reduction circuit 204 may also be referred to as a voltage droop mitigation circuit. The voltage droop reduction circuit 204 may be powered by another voltage supply 214 providing another supply voltage VDD2 and coupled to another capacitor 212. In certain aspects, VDD2 may be a higher voltage than VDD1. In some cases, the voltage droop reduction circuit may be powered by the voltage supply 208, as opposed to a different voltage supply (e.g., voltage supply 214). A person having ordinary skill in the art will realize that any capacitor (e.g., capacitor 210 or 212) illustrated in the figures and described herein may be physically realized with one or more capacitors as desired.

Figure 3:
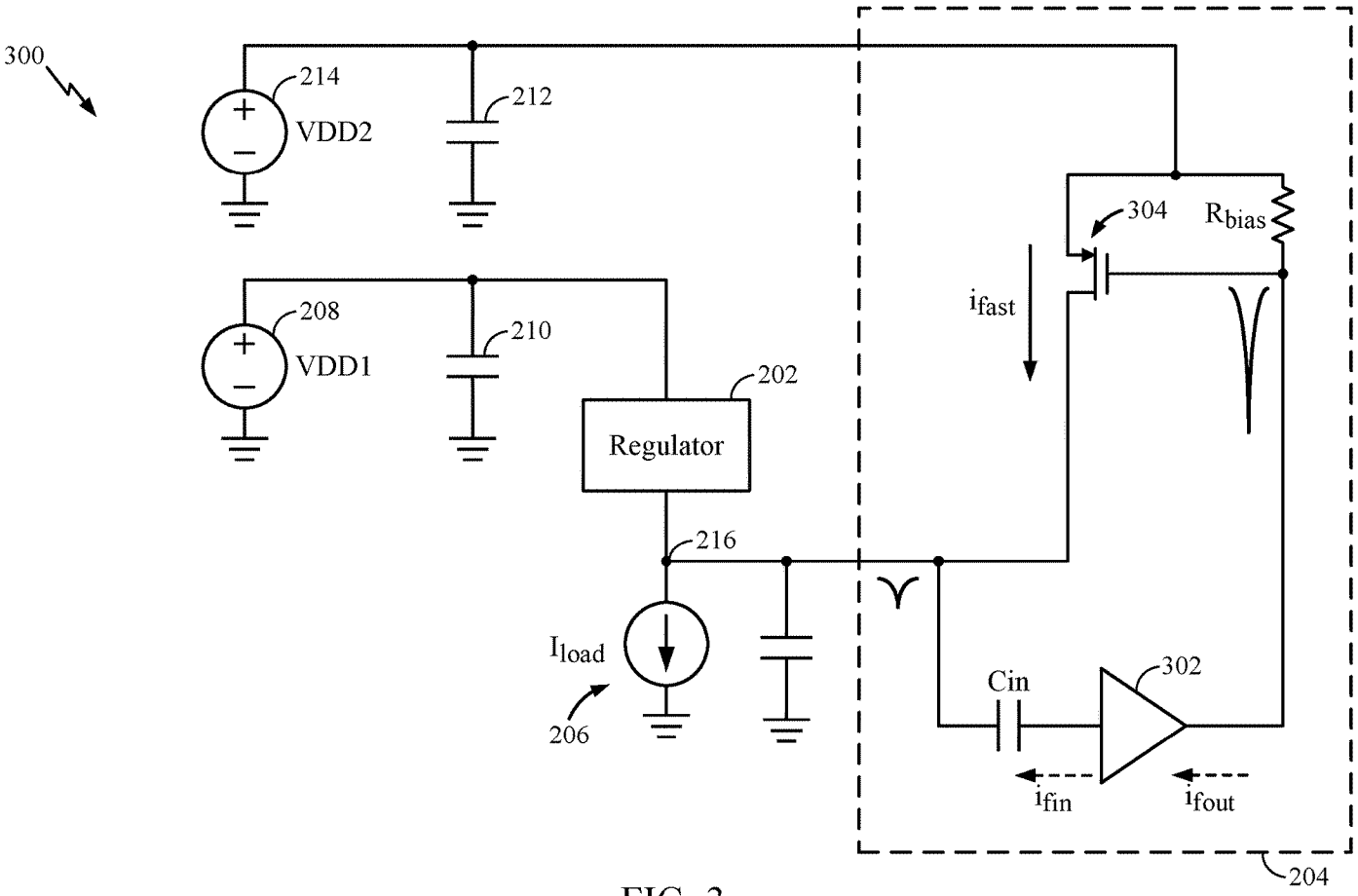
FIG. 3 illustrates an example power supply circuit with a voltage droop reduction circuit, in accordance with certain aspects of the present disclosure.

FIG. 3 illustrates an example power supply circuit 300 with a voltage droop reduction circuit 204, in accordance with certain aspects of the present disclosure. The voltage droop reduction circuit 204 may include a current amplifier 302 that may be coupled to the load 206 through an alternating-current (AC) coupling capacitor Cin. The AC coupling capacitor Cin senses a change in voltage at node 216, indicating a load attack, based on which the AC coupling capacitor Cin generates a current $i_{fin}$ at the input of the current amplifier 302. The current $i_{fin}$ is amplified by the current amplifier 302, generating a current $i_{fout}$.

The output of the current amplifier 302 is coupled to an impedance that may be implemented using, for example, a resistor $R_{bias}$. The resistor $R_{bias}$ may be coupled between the gate and the source of a transistor 304 (e.g., a PMOS transistor as illustrated). The current $i_{fout}$ flows across the resistor $R_{bias}$, setting the gate-to-source voltage (Vgs) of the transistor 304. In certain aspects, the resistance $R_{bias}$ may be set to reduce the static current consumption by the transistor 304. For example, Vgs of the transistor 304 may be set by selecting the resistance $R_{bias}$ such that the transistor 304 is in a mostly off-state, consuming little to no current (e.g., only leakage current), and increasing the power efficiency of the voltage droop reduction circuit 204.

Based on the Vgs of transistor 304, a current $i_{fast}$ flows from the source to the drain of transistor 304. Thus, the capacitor Cin, the current amplifier 302, and the transistor 304 form a loop (e.g., a feedback loop) that detects a change in voltage at node 216 and sources a current to the node 216 based on the detected change in voltage. As illustrated, a small change in voltage at node 216 results in a large change in Vgs of the transistor 304. Thus, the current $i_{fast}$ increases quickly in response to a change in voltage at node 216 that may be caused by a load attack. The current $i_{fast}$ flows to the node 216, mitigating any voltage droop that may be caused by the load attack. In other words, the current $i_{fast}$ can help to provide current to the load in order to meet the increased current demand from the load.

Figure 4:
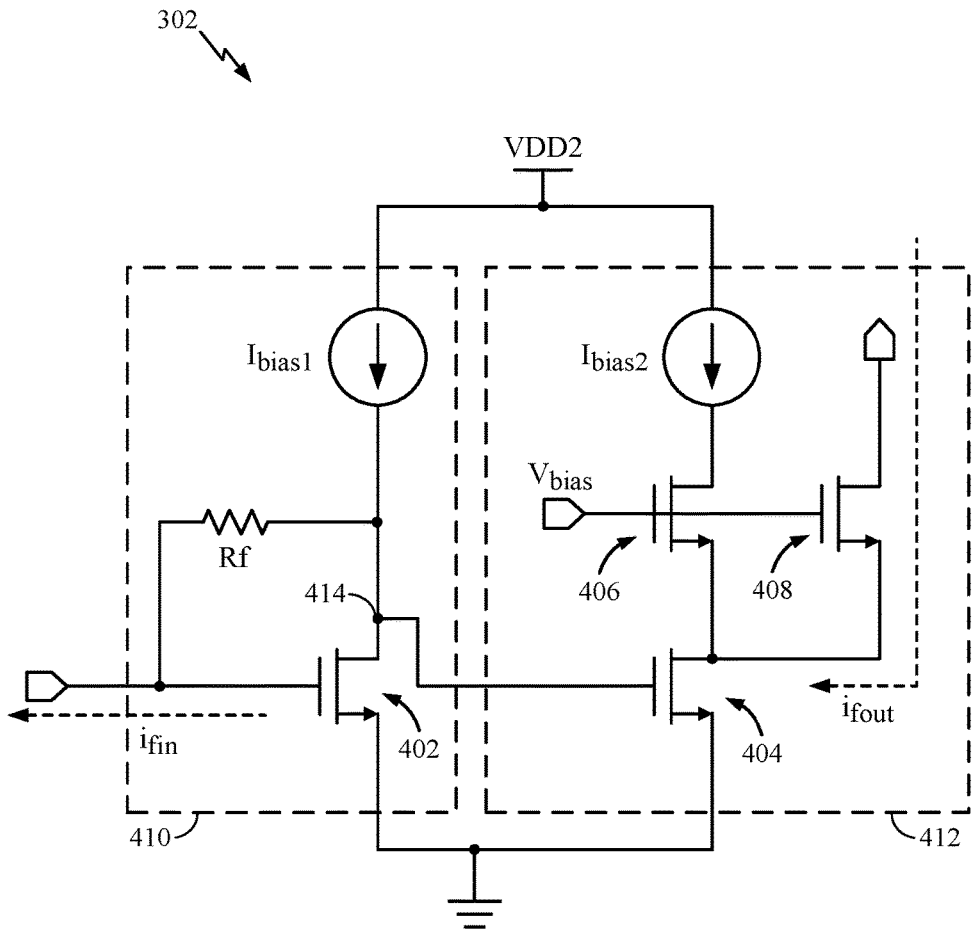
FIG. 4 illustrates an example current amplifier, in accordance with certain aspects of the present disclosure.

FIG. 4 illustrates an example current amplifier 302, in accordance with certain aspects of the present disclosure. The example current amplifier 302 may include a transimpedance amplifier (TIA) 410 and a transconductance amplifier 412. The TIA 410 receives the current $i_{fin}$ provided by the capacitor Cin at the gate of a transistor 402 and converts the current $i_{fin}$ to a voltage at node 414. The TIA 410 includes an impedance coupled between the drain and the gate of the transistor 402, and a current source Ibias1 that provides a biasing current for the TIA 410.

The transconductance amplifier 412 includes a transistor 404 having a gate coupled to the node 414 and generates the current $i_{fout}$ based on the voltage at node 414. In certain aspects, the transconductance amplifier 412 includes a current source Ibias2 which generates a biasing current that flows to the transistor 404. In certain aspects, the transconductance amplifier 412 also includes current-limiting devices coupled to the drain of transistor 404, which may be implemented using transistors 406 and 408. In certain aspects, the transistor 406 may be biased using a biasing voltage Vbias. In some cases, the transistor 408 may be biased using the same biasing voltage Vbias.

Figure 5:
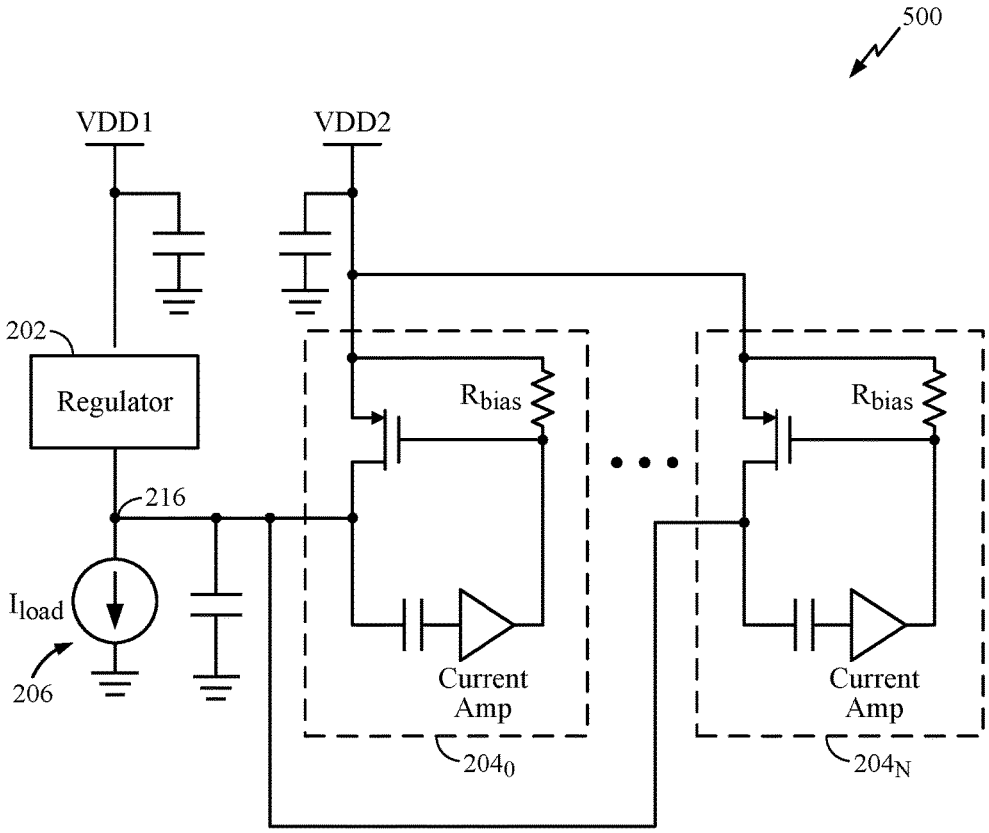
FIG. 5 illustrates an example power supply circuit with multiple voltage droop reduction circuits, in accordance with certain aspects of the present disclosure.

FIG. 5 illustrates an example power supply circuit 500 with multiple voltage droop reduction circuits, in accordance with certain aspects of the present disclosure. As illustrated, the node 216 of the power supply circuit 500 may be coupled to a plurality of voltage droop reduction circuits $\mathbf{204}_0$ to $\mathbf{204}_N$, allowing for further reduction of voltage droop that may be caused by a load attack. As illustrated, the voltage droop reduction circuits $\mathbf{204}_0$ to $\mathbf{204}_N$ may be coupled to the voltage rail VDD2, or in some cases, may be coupled to the voltage rail VDD1.

Figure 6:
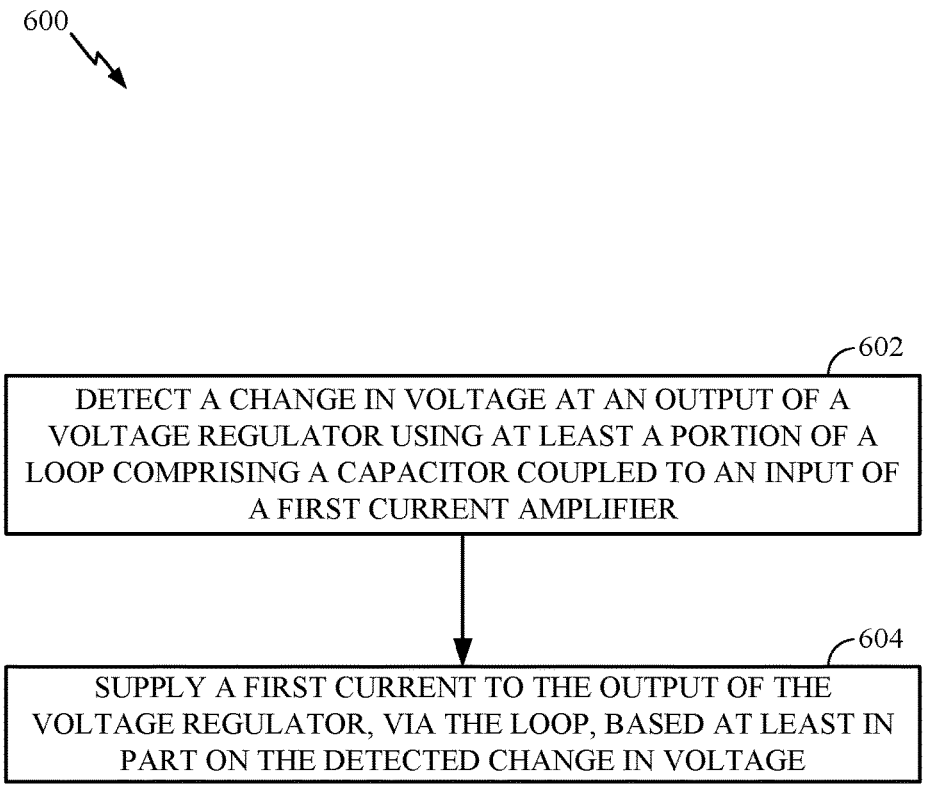
FIG. 6 illustrates example operations for reducing voltage droop, in accordance with certain aspects of the present disclosure.

FIG. 6 is a flow diagram of example operations 600 for reducing voltage droop, in accordance with certain aspects of the present disclosure. In certain aspects, the operations 600 may be performed by a power supply circuit, such as the power supply circuit 300 of FIG. 3 or power supply circuit 500 of FIG. 5.

The operations 600 may begin, at block 602, by detecting a change in voltage at an output of a voltage regulator (e.g., regulator 202) using at least a portion of a loop comprising a capacitor (e.g., capacitor Cin) coupled to an input of a first current amplifier (e.g., current amplifier 302). At block 604, the power supply circuit may supply a first current (e.g., $i_{fast}$) to the output of the voltage regulator, via the loop, based at least in part on the detected change in voltage.

In certain aspects, the operations 600 also include generating a second current (e.g., current $i_{fin}$) based on the detected change in voltage at the output of the voltage regulator. In this case, the generated second current is amplified via the current amplifier, a gate-to-source voltage (Vgs) of a first transistor (e.g., transistor 304) coupled to the loop is adjusted based on the amplified current, and the first current is supplied to the output of the voltage regulator via the first transistor.

In certain aspects, the operations 600 also include converting the generated second current to a voltage, wherein the amplified current is generated based on the voltage. In certain aspects, adjusting the Vgs of the first transistor comprises sinking the amplified current though an impedance (e.g., resistor $R_{bias}$) coupled between the gate and the source of the first transistor. In certain aspects, the first current comprises a source-to-drain current of the first transistor. In some cases, the first transistor comprises a p-channel metal-oxide-semiconductor (PMOS) transistor.

In certain aspects, the operations 600 also include generating a third current based on detection of the voltage change at the output of the voltage regulator, amplifying the generated third current, adjusting a Vgs of a second transistor based on the amplified third current, and supplying a fourth current to the output of the voltage regulator via the second transistor. In certain aspects, the operations 600 also include regulating (e.g., via regulator 202) the voltage at the output of the voltage regulator, wherein the change in the voltage at the output of the voltage regulator corresponds to an increased load current draw from the output of the voltage regulator.

The various operations of methods described above may be performed by any suitable means capable of performing the corresponding functions. The means may include various hardware and/or software component(s) and/or module (s), including, but not limited to a circuit, an application-specific integrated circuit (ASIC), or processor. Generally, where there are operations illustrated in figures, those operations may have corresponding counterpart means-plus-function components with similar numbering.

For example, means for generating may comprise a capacitor (e.g., the capacitor Cin of FIG. 3), means for amplifying may comprise a current amplifier (e.g., the current amplifier 302 of FIG. 3), means for adjusting may comprise an impedance (e.g., the resistors $R_{bias}$ of FIG. 3), means for converting may comprise a TIA (e.g., the TIA 410 of FIG. 4), and means for regulating may comprise a regulator (e.g., the regulator 202 of FIG. 2).

As used herein, the term "determining" encompasses a wide variety of actions. For example, "determining" may include calculating, computing, processing, deriving, investigating, looking up (e.g., looking up in a table, a database, or another data structure), ascertaining, and the like. Also, "determining" may include receiving (e.g., receiving information), accessing (e.g., accessing data in a memory), and the like. Also, "determining" may include resolving, selecting, choosing, establishing, and the like.

As used herein, a phrase referring to "at least one of" a list of items refers to any combination of those items, including single members. As an example, "at least one of: a, b, or c" is intended to cover: a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

The various illustrative logical blocks, modules and circuits described in connection with the present disclosure may be implemented or performed with a general purpose processor, a digital signal processor (DSP), an ASIC, a field programmable gate array (FPGA) or other programmable logic device (PLD), discrete gate or transistor logic, discrete hardware components, or any combination thereof designed to perform the functions described herein. A general-purpose processor may be a microprocessor, but in the alternative, the processor may be any commercially available processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The methods disclosed herein comprise one or more steps or actions for achieving the described method. The method steps and/or actions may be interchanged with one another without departing from the scope of the claims. In other words, unless a specific order of steps or actions is specified, the order and/or use of specific steps and/or actions may be modified without departing from the scope of the claims.

The functions described may be implemented in hardware, software, firmware, or any combination thereof. If implemented in hardware, an example hardware configuration may comprise a processing system in a wireless node. The processing system may be implemented with a bus architecture. The bus may include any number of interconnecting buses and bridges depending on the specific application of the processing system and the overall design constraints. The bus may link together various circuits including a processor, machine-readable media, and a bus interface. The bus interface may be used to connect a network adapter, among other things, to the processing system via the bus. The network adapter may be used to implement the signal processing functions of the physical (PHY) layer. In the case of a user terminal, a user interface (e.g., keypad, display, mouse, joystick, etc.) may also be connected to the bus. The bus may also link various other circuits such as timing sources, peripherals, voltage regulators, power management circuits, and the like, which are well known in the art, and therefore, will not be described any further.

The processing system may be configured as a general-purpose processing system with one or more microprocessors providing the processor functionality and external memory providing at least a portion of the machine-readable media, all linked together with other supporting circuitry through an external bus architecture. Alternatively, the processing system may be implemented with an ASIC with the processor, the bus interface, the user interface in the case of an access terminal), supporting circuitry, and at least a portion of the machine-readable media integrated into a single chip, or with one or more FPGAs, PLDs, controllers, state machines, gated logic, discrete hardware components, or any other suitable circuitry, or any combination of circuits that can perform the various functionality described throughout this disclosure. Those skilled in the art will recognize how best to implement the described functionality for the processing system depending on the particular application and the overall design constraints imposed on the overall system.

It is to be understood that the claims are not limited to the precise configuration and components illustrated above. Various modifications, changes and variations may be made in the arrangement, operation and details of the methods and apparatus described above without departing from the scope of the claims.

What is claimed is:

1. A voltage droop reduction circuit comprising:

a loop coupled to an output of a voltage regulator, the loop comprising a first current amplifier and a first transistor having a gate, a source, and a drain;

a first capacitor coupled between the output of the voltage regulator and an input of the first current amplifier, an output of the first current amplifier being coupled to the gate of the first transistor; and a resistive element coupled between the gate and the source of the first transistor, the first capacitor being further coupled between the drain of the first transistor and the input of the first current amplifier.

2. The voltage droop reduction circuit of claim 1, wherein:

the output of the first current amplifier is coupled directly to the gate of the first transistor; and the voltage regulator comprises a low-dropout (LDO) regulator.

3. The voltage droop reduction circuit of claim 1, wherein the first transistor comprises a p-channel metal-oxide-semiconductor (PMOS) transistor.

4. The voltage droop reduction circuit of claim 1, wherein the first current amplifier comprises:

a transimpedance amplifier (TIA) having an input coupled to the first capacitor; and a transconductance amplifier having an input coupled to an output of the TIA, and an output coupled to the gate of the first transistor.

5. The voltage droop reduction circuit of claim 4, wherein the TIA comprises:

a second transistor having a drain coupled to the input of the transconductance amplifier;

an impedance coupled between a gate and a drain of the second transistor; and a first current source coupled to the drain of the second transistor.

6. The voltage droop reduction circuit of claim 5, wherein the transconductance amplifier comprises:

a third transistor having a gate coupled to the drain of the second transistor; and a second current source coupled to a drain of the third transistor.

7. The voltage droop reduction circuit of claim 6, wherein the transconductance amplifier further comprises:

a first current-limiting device coupled between the second current source and the drain of the third transistor; and a second current-limiting device coupled between the output of the first current amplifier and the drain of the third transistor.

8. The voltage droop reduction circuit of claim 1, wherein the source of the first transistor is coupled to a first voltage rail.

9. A voltage droop reduction circuit comprising:

a loop coupled to an output of a voltage regulator, the loop comprising a first current amplifier and a first transistor having a gate, a source, and a drain; and a first capacitor coupled between the output of the voltage regulator and an input of the first current amplifier, an output of the first current amplifier being coupled to the gate of the first transistor, the source of the first transistor being coupled to a first voltage rail, the drain of the first transistor being coupled to the output of the voltage regulator, and the voltage regulator being powered by a second voltage rail.

10. The voltage droop reduction circuit of claim 9, wherein the second voltage rail has a higher voltage than the first voltage rail.

11. The voltage droop reduction circuit of claim 1, further comprising:

a second transistor having a gate, a source, and a drain, the drain of the second transistor being coupled to the drain of the first transistor;

a resistor coupled between the gate and the source of the second transistor;

a second current amplifier having an output coupled to the gate of the second transistor; and a second capacitor coupled between the drain of the second transistor and an input of the second current amplifier.

12. The voltage droop reduction circuit of claim 11, wherein the sources of the first transistor and the second transistor are coupled to a voltage rail.

13. A method for reducing voltage droop, comprising:

detecting a change in voltage at an output of a voltage regulator using at least a portion of a loop comprising a capacitor coupled to an input of a first current amplifier;

supplying a first current to the output of the voltage regulator, via the loop, based at least in part on the detected change in voltage;

generating a second current based on the detected change in voltage at the output of the voltage regulator;

amplifying the generated second current via the current amplifier;

adjusting a gate-to-source voltage (Vgs) of a first transistor coupled to the loop based on the amplified current; and supplying the first current to the output of the voltage regulator via the first transistor.

14. The method of claim 13, further comprising:

converting the generated second current to a voltage, wherein the amplified current is generated based on the voltage.

15. The method of claim 13, wherein adjusting the Vgs of the first transistor comprises sinking the amplified current though an impedance coupled between the gate and the source of the first transistor.

16. The method of claim 13, wherein the first current comprises a source-to-drain current of the first transistor.

17. The method of claim 13, wherein the first transistor comprises a p-channel metal-oxide-semiconductor (PMOS) transistor.

18. The method of claim 13, further comprising:

generating a third current based on detection of the voltage change at the output of the voltage regulator;

amplifying the generated third current;

adjusting a gate-to-source voltage (Vgs) of a second transistor based on the amplified third current; and supplying a fourth current to the output of the voltage regulator via the second transistor.

19. The method of claim 13, further comprising:

regulating the voltage at the output of the voltage regulator, wherein the change in the voltage at the output of the voltage regulator corresponds to an increased load current draw from the output of the voltage regulator.

20. An apparatus for reducing voltage droop, comprising:

means for generating a first current based on detection of a change in voltage at a node;

means for amplifying the generated first current; and means for adjusting a gate-to-source voltage (Vgs) of a first transistor based on the amplified current, a drain of the first transistor being coupled to the node;

means for generating a second current based on detection of the change in voltage at the node;

means for amplifying the generated second current; and means for adjusting a gate-to-source voltage (Vgs) of a second transistor based on the amplified second current, wherein a drain of the second transistor is coupled to the node.

21. The apparatus of claim 20, further comprising:

means for converting the generated current to a voltage, wherein the amplified current is generated based on the voltage.

22. The apparatus of claim 20, wherein the means for adjusting is coupled between the gate and the source of the first transistor.

23. The apparatus of claim 20, wherein a source-to-drain current of the first transistor is provided to the node.

24. The apparatus of claim 20, wherein the first transistor comprises a p-channel metal-oxide-semiconductor (PMOS) transistor.

25. The apparatus of claim 20, further comprising:

means for regulating the voltage at the node, wherein the change in the voltage at the node corresponds to an increased load current draw from the node.

* * * * *